United States Patent [19]

Forbes et al.

[11] 3,971,368

[45] July 27, 1976

[54] COMBINED OXYGEN MASK AND SMOKE GOGGLE APPARATUS WITH AUTOMATIC FLUSH VALVE

[75] Inventors: Robert Stafford Forbes, Leawood; Gary Dean Herrick, Olathe; Robert Julius Richter, Overland Park, all of Kans.

[73] Assignee: Puritan Equipment, Inc., Lenexa, Kans.

[22] Filed: Aug. 13, 1975

[21] Appl. No.: 604,465

[52] U.S. Cl. ..... 128/142 R

[51] Int. Cl.[2] ..... A62B 7/00

[58] Field of Search ..... 128/141 R, 142, 142.2, 128/142.4, 146, 146.3, 146.4, 145 A, 147

[56] References Cited

UNITED STATES PATENTS

| | | | |
|---|---|---|---|
| 2,818,858 | 1/1958 | Holm | 128/147 |
| 3,018,776 | 1/1962 | Saitta et al. | 128/142.4 |
| 3,433,222 | 3/1969 | Pinto | 128/142.2 |
| 3,910,269 | 10/1975 | Ansite et al. | 128/142 R |

*Primary Examiner*—Robert W. Michell
*Assistant Examiner*—Henry J. Recla
*Attorney, Agent, or Firm*—Schmidt, Johnson, Hovey & Williams

[57] ABSTRACT

Combined oxygen mask and smoke goggle apparatus particularly adapted for use by members of flight crews is provided in which a valve having a shiftable actuating element and including means presenting a passage is mounted atop the face-piece of the oxygen mask for automatic opening of such valve whenever the mask and goggles are both in place on the face of a user, so that the mask will normally be sealed against the escape of oxygen introduced thereinto but oxygen will be automatically introduced into the goggles for flushing smoke or the like therefrom whenever the goggles are being utilized along with the mask.

6 Claims, 6 Drawing Figures

Fig.2.
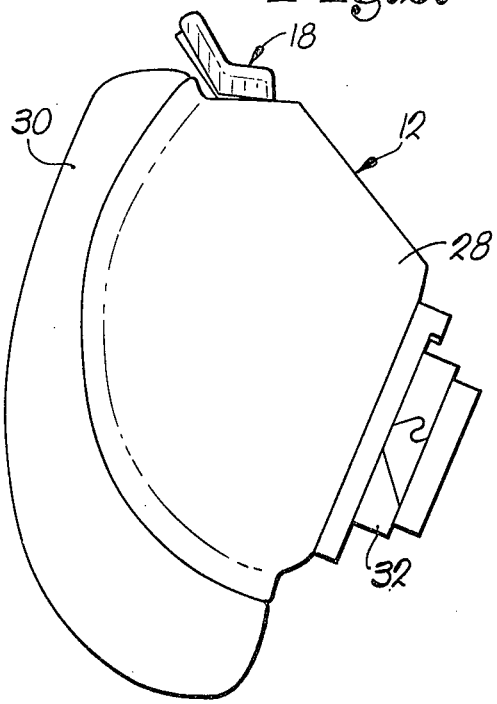
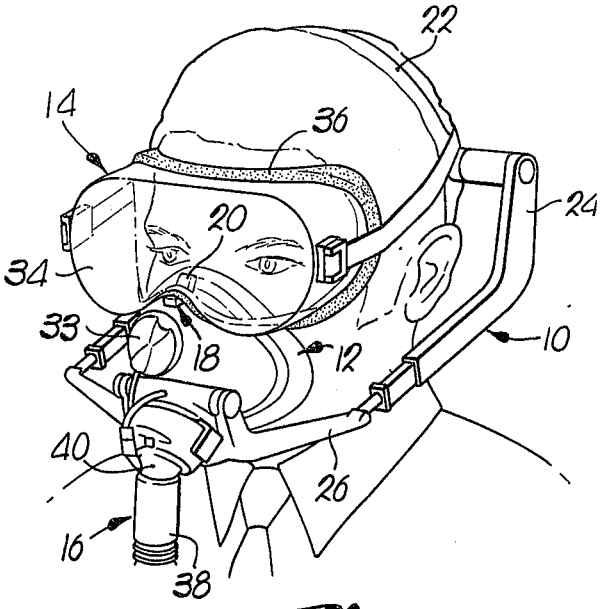
Fig.1.
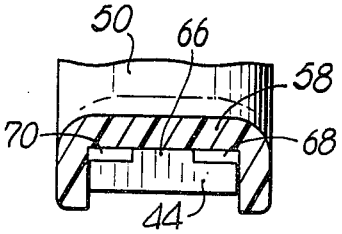
Fig.5.
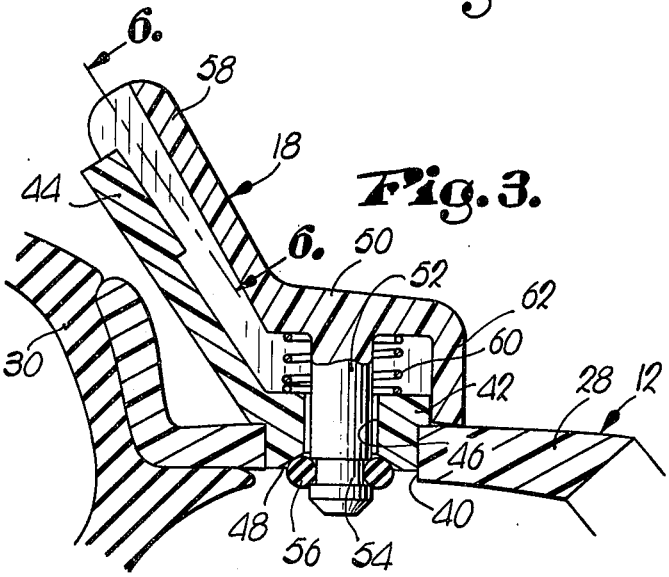
Fig.3.
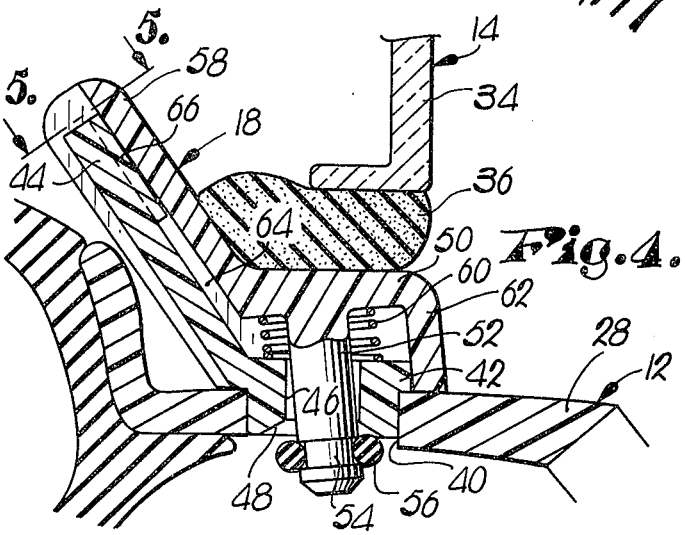
Fig.4.
Fig.6.
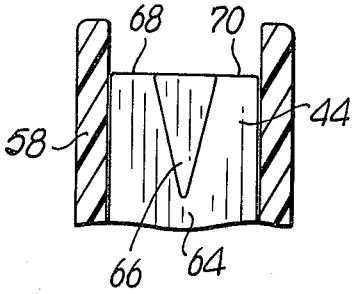

COMBINED OXYGEN MASK AND SMOKE GOGGLE APPARATUS WITH AUTOMATIC FLUSH VALVE

This invention relates to protective breathing and vision maintenance apparatus for use by persons who may be subjected to conditions involving not only a necessity for being supplied with an artificial source of breathable gas, but also a necessity for the concurrent protection of their eyes against smoke or other noxious fumes. One primary area of application for the invention is its employment in connection with the safety equipment required by flight crews of military, commercial and even private aircraft. More particularly, the invention is concerned with providing improvements in breathing mask and goggle apparatus, including conduit means for placing the chambers formed between the face of a user and the oxygen mask and goggles respectively in communication with each other, with such conduit means being normally closed by valve means adapted for automatically opening the conduit means when both the mask and the goggles are in place on the face of a user, so that a portion of the breathable gas being supplied to the mask will automatically be diverted into the chamber between the face of the user and the goggles to flush the latter.

The problem to which the invention is directed is concerned with the situation that arises when, for example, the cockpit of an aircraft suffers both a loss of cabin pressure while at high altitude and the presence of smoke or other fumes which would be irritating to the eyes, which events may occur substantially simultaneously under emergency conditions. When such a situation is presented, it is important that flight crew members be provided as quickly as possible with a source of oxygen or other breathable gas, in order that they may maintain consciousness or alertness and return their attention to their duties in handling the aircraft with a minimum of interruption. That aspect of the problem per se has heretofore been essentially solved by the development of so-called "quick-donning" oxygen mask assemblies such as illustrated in U.S. Pat. No. 3,040,741 or U.S. Pat. No. 3,850,168. The employment of goggles along with an oxygen mask has, of itself, also been common in the past, it being noted that when both of such protective devices are to be used simultaneously, the nature of the mask assembly normally requires that it be first properly emplaced on the face of a user and the goggles then subsequently positioned. Critical difficulty with the mere concurrent use of an oxygen mask and goggles has been experienced in practice, however, by virtue of the fact that the goggles tend to entrap therein during emplacement on the face of the user any smoke or other noxious fumes that may have pervaded the cockpit area.

In an effort to meet the last mentioned aspect of the problem, goggles have been developed which are provided with one or more plastic tubes communicating with the interior thereof and depending sufficiently therefrom to permit such tube means being inserted between the normally sealed interface between the edge of the face-piece of an oxygen mask and the face of the user, so that oxygen will pass from the mask into the goggles for flushing the latter. Such apparatus has been found deficient in practice, however, primarily by virtue of the time required during emplacement of the goggles by the user upon his face to also lift the edge of the mask from his face and properly fit the communicating tube from the goggles under the edge of his mask. At best, such procedure will normally require the user to employ both of his hands for such purpose, at a time when the use of one of his hands may be vitally needed for aircraft handling or initiating other emergency procedures. Since the user is often under some stress in the face of emergency conditions requiring the donning of an oxygen mask and goggles, this too seems to contribute to the time normally required for proper emplacement of the protective apparatus. Under certain circumstances, it is also possible that the necessity for lifting the mask away from the user's face in order to position the tube means from the goggles therebetween will result in ingress into the mask itself of smoke or other noxious fumes further adding to the user's problems.

It will be appreciated that in some types of emergency situations, it may be necessary or desirable to employ only a breathing mask without the concurrent use of goggles. Since conservation of the oxygen supply will often be a critical consideration, particularly with military aircraft engaged in a long, high altitude flight, the possibility of simplifying the proper emplacement of both a mask and goggles by mounting the communication tube means on the mask rather than the goggles has not proved practical because of the significant loss of oxygen then accompanying use of the mask alone.

Accordingly, it is the primary object of this invention to solve the above mentioned problem and avoid the limitations and disadvantages of apparatus previously used or proposed for such purpose and to do so in a reliable manner by means requiring a minimum modification of existing and accepted types of oxygen mask assemblies and goggles per se, for the sake of not only economy, but in the interests of requiring a minimum of retraining of personnel for acceptance and use of the improved equipment.

Another important object of the invention is to accomplish such improvement of combined oxygen mask and goggles apparatus through the provision of suitable gas conduit and associated valve means on the face-piece of the oxygen mask, with the conduit means being arranged to automatically be properly positioned for communicating with the chamber between the face of the user and the goggles when the latter are in place, and with the normally closed valve means including a shiftable actuating element that will be engaged and shifted by the goggles whenever the latter are emplaced on the face of the user to automatically open the valve for the passage of breathable gas through the conduit into the goggles to flush the latter.

Still other significant objects and advantages of the invention will be made clear or become apparent to those skilled in the art from the accompanying drawings and the description of a preferred embodiment of the invention that follows. In the accompanying drawings:

FIG. 1 is a perspective view of our preferred embodiment of combined oxygen mask and goggle apparatus embodying the invention, shown in operative position upon the head of a user;

FIG. 2 is a side elevational view of the face-piece portion of the oxygen mask showing the valve and conduit means contemplated by the invention adjacent the top thereof;

FIG. 3 is a fragmentary cross sectional view of a portion of the face-piece of the oxygen mask and the valve and conduit means employed in the invention, in the normal condition thereof with the valve means closed as would be the case when the goggles portion of the apparatus are not being used or have not yet been emplaced on the face of the user;

FIG. 4 is a fragmentary cross sectional view similar to FIG. 3, except that a part of the goggles portion of the apparatus is also depicted in operative disposition engaging the actuating element of the valve to shift such element and open the valve;

FIG. 5 is a cross sectional view taken on line 5—5 of FIG. 4; and

FIG. 6 is a cross sectional view taken on line 6—6 of FIG. 3.

Referring now initially to FIG. 1, the primary portions of the apparatus may be identified as an oxygen mask assembly generally designated 10 and having a face-piece 12, a goggles assembly 14, means 16 coupled with the face-piece 12 for supplying oxygen or other breathable gas to the latter from any suitable supply thereof (not shown), and a combined valve and conduit means 18 provided by the invention and shown in its preferred position atop the face-piece 12 and with a portion 20 thereof extending between the face of the user and the goggles assembly 14 into communication with the interior of the latter.

The oxygen mask assembly 10 may be of any suitable quick-donning construction, but is illustrated herein as being of the form disclosed in the previously mentioned U.S. Pat. No. 3,850,168, the construction of which is generally familiar to those skilled in the art or may be determined from such patent. In general, however, it will be noted that the mask assembly 10 includes a ring 22 adapted to engage the upper rear portion of a user's head, a pair of opposite side members 24 of extensible length extending downwardly and forwardly from the ring 22, a cross member 26 interconnecting the front extremities of the side members 24, and a face-piece 12 pivotally mounted on the cross member 26 for accommodating the face-piece 12 to better fit the profile of a particular user.

Aside from the valve and conduit means 18 hereinafter to be described in more detail, the face-piece 12 will typically include a body portion 28 formed of rubber, plastic or the like and usually having a generally frustoconical configuration to present a chamber for breathable gas in communication with the mouth and nose of the user, a peripheral sealing element 30 of softer material such as silicone or the like extending around the inner edge to effect a substantially tight seal for the chamber presented by the face-piece 12 and the face of the user, and suitable coupling fittings 32 to which the source of oxygen or other breathable gas may be connected. If desired, other accessories such as a microphone 33 may also be carried by the face-piece 12.

The goggles assembly 14 may per se also be of any suitable form including a front transparent element or portion 34 provided with a peripheral sealing element 36 of suitable soft material around the inner edge of the transparent element 34 for effecting a reasonable degree of sealing with the face of any user. For reasons hereinafter noted, it is preferred that the sealing between the element 36 of the goggle assembly 14 and the face of the user not be quite so tight as the seal effected between the sealing element 30 of the face-piece 12 and the face of the user, in order that gas supplied to the interior of the goggles assembly 14 under pressure may escape as required between the element 36 and the face of the user during initial and continued flushing of the goggles assembly 14, but without there being such gaps between the sealing element 36 and the face of the user as might tend to admit smoke or other noxious gases.

The means 16 for placing the face-piece 12 in communication with a supply of oxygen or other suitable breathable gas will typically comprise merely a length of flexible tubing 38 provided with a fitting 40 at its outlet extremity adapted for convenient sealed coupling with the inlet fitting 32 on the face-piece 12.

Before proceeding to a more detailed consideration of the improvements made upon the mentioned combination of elements by this invention, it may be observed that our improved apparatus still contemplates that the procedure to be followed by a user during an emergency would involve first emplacing the mask assembly 10, then, when required, emplacing the goggles assembly 14 in operative position upon his head and face. As will be perceived, each of such operations can be accomplished with a single hand and completed quickly in a single sweeping movement for each of the assemblies 10 and 14. As will become further apparent, however, all need for using both hands or re-manipulating either the asseembly 10 or the assembly 14 in order to accomplish their desired functional cooperation is eliminated by this invention.

Referring now more particularly to FIGS. 3, 4, 5 and 6, it will be seen that our preferred form of combined valve and conduit means 18 is constructed and installed on the face-piece 12 in the following manner. A hole 40 is formed in the top of the body 28 of the face-piece 12 adjacent the sealing element 30 of the latter. The annular base portion 42 of a member also including an upwardly and outwardly extending leg 44, which may be formed of plastic material, is mounted and sealed into the hole 40 by cementing or in any other suitable fashion. The annular member portion 42 has an upright bore 46 which is beveled at its lower extremity to present an annular valve seat 48 facing and communicating with the interior of the body 28 of face-piece 12.

A valve assembly 50, which is shiftable relative to the member 42–44, includes a stem portion 52 loosely extending through the bore 46 and provided with a groove 54 for receiving an O-ring 56 adapted to sealingly engage the valve seat 48 when the stem 52 is disposed in alignment with the axis of bore 46 and biased upwardly. Thus, the stem 52 and O-ring 56 provide a valve part adapted for closing the lower extremity of the bore 46 when the O-ring 56 is in sealing engagement with the valve seat 48. The valve assembly 50 further includes a shiftable actuating element 58 which inclines upwardly at an angle disposing the same in generally overlying relationship to the leg 44 of the member 42–44. The actuating element 58 is normally biased toward the position illustrated in FIG. 3 by a compression spring 60 between the upper surface of the annular base 42 of member 42–44 and the lower surface of the actuating element 58. A depending flange 62 on the assembly 50 cooperates with the spring 60 to normally maintain the assembly 50 in the relationship to the body 28 and the member 42–44 depicted in FIG. 3, in which it will be noted that the lower extemity of the bore 46 is closed by the above mentioned valving action, and that the actuating element 58 is somewhat spaced away from the fixed leg 44 of the member 42–44. In this condition of the valve and conduit means 18, the chamber within the body 28 of the face-piece 12 is sealed against the egress of gas through the bore 46.

As shown in FIG. 4, however, when the goggles 14 are moved into operative position upon the face of a user, the peripheral sealing element 36 at the bottom of the goggles 14 adjacent the user's nose engages the top of the actuating element 18 to shift the same toward the fixed leg 44 of the member 42–44, and does so automatically merely from the emplacement of the goggles 14 in their operative position without any necessity for special or additional manipulations of any part of the apparatus by the user. When the actuating element 58 is thus shifted, the stem 52 of the assembly 50 is tilted away from its normal alignment with the axis of the bore 46, which in turn moves the O-ring 56 away from the valve seat 48 to open the lower extremity of the bore 46 into fluid communication with the chamber within the body 28 of the face-piece 12. As will be most apparent from FIGS. 2 and 5, the cross sectional configuration of the actuating element 58 is channel-like and of dimensions relative to the fixed leg 44 of member 42–44 such that, with the actuating element 58 so shifted, it and the leg 44 cooperatively present a conduit having a passage 64 extending from the upper extremity of the bore 46 toward the upper extremity of the element 58 and leg 44. As best shown in FIGS. 5 and 6, the leg 44 is provided with a generally triangular boss 66 thereon facing the element 58, which serves to divide the passage 64 into a pair of laterally displaced outlets 68 and 70 at the upper extremity thereof. As will be clear from FIG. 4, such outlets 68 and 70 are disposed within the chamber between the goggles 14 and the face of the user when the goggles 14 have been emplaced into operative position, so that the divider 66 and the dual outlets 68 and 70 for the extremity of the passage 64 within the goggles 14 will serve to separate breathable gas entering the goggles 14 into separate right and left streams to assure adequate flushing of and circulation of the gas within such chamber.

In operation of the apparatus, upon being presented with a situation requiring an artificial source of breathable gas, the user emplaces the mask assembly 10 upon his face and head with one hand and in a single sweeping motion. Initially, and unless the goggles 14 are also emplaced in operative position upon the user's head, the valve and conduit means 18 will remain in the condition thereof depicted in FIG. 3 in which the valve parts 56 and 48 are sealed to close the lower extremity of the bore 46 and prevent the escape of any breathable gas through the valve and conduit means 18.

In a situation in which the user also needs to employ the goggles 14, however, he may quickly emplace them in operative position upon his face and head with one hand and by means of a second sweeping motion. As the goggles 14 are seated upon the user's face, a lower portion of the goggles 14 will engage the shiftable actuating element 58 of the valve assembly 50 to tilt or/and depress the valve stem 52, thereby opening the valve 56–48 and placing the chamber within the face-piece 12 in communication with the chamber within the goggles 14 via the bore 46, the passage 64 and the outlets 68 and 70 of the conduit portion of the means 18 provided by the cooperative relationship between the element 58 and the leg 44 with the assistance of the flange 62 as a lateral enclosing structure. Thereupon, breathable gas from the face-piece 12 will immediately commence to flow through the means 18 into the goggles 14 for flushing the latter and maintaining the chamber therewithin in contact with the user's eyes free of smoke or noxious gases.

If and when a situation initially requiring the use of the goggles 14 for safety purposes has improved in manner no longer requiring the employment of the goggles 14 but still necessitating the use of the mask 10, the goggles 14 may simply be removed by the user, whereupon the valve parts 56–48 of the means 18 will immediately and automatically close to cutoff what would then be a wasteful escape of breathable gas from the face-piece 12.

The solution thus achieved by the invention for what has been a long standing problem in the fields in which such equipment is used will now be appreciated to have attained the required reliability and the desired economy with respect to both manufacturing and maintenance requirements by means of structure that is simple and straightforward in both construction and operation. Those skilled in the art will appreciate, however, that various minor modifications as to form and details could be made from the preferred embodiment shown and described for illustrative purposes without departing from the gist and essence of the invention or the novel combination of elements and relationships involved therein. Accordingly, it should be understood that it is intended for the invention to be deemed limited only by the fair scope of the claims that follow, including variations constituting mere mechanical equivalents thereof.

We claim:

1. In protective breathing and vision maintenance apparatus;

breathing mask means having a face-piece adapted to fit over the nose and mouth area of the face of a user to present a first chamber between said mask means and the face of the user, said mask means including inlet means through which breathable gas under pressure may be supplied to said first chamber;

goggle means adapted to fit over the eyes area of the face of a user and to present a second chamber between said goggle means and the face of the user;

conduit means adapted for placing said chambers in fluid communication with each other for the passage of gas from said first chamber into said second chamber said goggle means including means for operably engaging said conduit means for displacing the latter from a first position, in which said first chamber is not in fluid communication with said second chamber, to a second position in response to the positioning of said goggle means, in which said first chamber is in fluid communication with said second chamber; and valve means operably associated with said conduit means for opening and closing the latter for the passage of said gas from said first chamber into said second chamber, whereby said valve means is opened in response to the displacement of said conduit means into said second position and closed in response to the displacement of said conduit means into said first position, and whereby gas under pressure will automatically be supplied from said first chamber to said second chamber to flush out said goggle means when the latter are in place on the face of the user, but said first chamber will be substantially sealed by the closing of said valve means to conserve said gas when said goggle means are not in place on the face of the user.

2. The invention of claim 1, wherein said valve means includes a shiftable actuating element disposed to be engaged and shifted by said goggle means when the latter is in place on the face of the user.

3. The invention of claim 2, wherein said conduit means is mounted on said mask means for communication with said first chamber and is disposed for extending between the face of the user and said goggle means when the latter is in place on the face of the user.

4. The invention of claim 3, wherein said conduit means includes passage means defined by said shiftable actuating element and a cooperating, fixed member on said mask means.

5. The invention of claim 4, wherein said passage means terminates in a plurality of outlets disposed for directing said gas into different portions of said second chamber when said goggle means are in place on the face of the user.

6. The invention of claim 1, wherein said mask means is provided with an opening in the top thereof, and said valve means includes a member mounted in said opening and providing a valve seat therein, a shiftable element including a valve part cooperable with said valve seat, and means for yieldably biasing said valve part into closing relationship with said valve seat, said valve part being separable from said valve seat to open said valve means when said element is shifted against the action of said biasing means.

* * * * *